455-601 AU 263 EX
7/21/87 XR 4,682,144

United States Patent [19]

Ochiai et al.

[11] Patent Number: 4,682,144

[45] Date of Patent: Jul. 21, 1987

[54] LIGHT TRANSMISSION SYSTEM FOR TRAINS

[75] Inventors: Hajime Ochiai, Nishinomiya; Kenji Morihara, Takarazuka, both of Japan

[73] Assignee: Mitsubishi Denki Kabushiki Kaisha, Tokyo, Japan

[21] Appl. No.: 788,971

[22] Filed: Oct. 18, 1985

Related U.S. Application Data

[63] Continuation-in-part of Ser. No. 598,451, Apr. 9, 1984, abandoned.

[30] Foreign Application Priority Data

Apr. 7, 1983 [JP] Japan ..... 58-62488

[51] Int. Cl.[4] ..... B61L 15/00; G08B 26/00

[52] U.S. Cl. ..... 340/48; 340/505; 340/508; 340/531; 340/825.54; 246/167 R; 455/600; 455/601

[58] Field of Search ..... 340/47-50, 340/505-508, 531, 536, 825.02, 825.05, 825.06-825.13, 825.54; 246/167 R, 166, 174, 192 R, 175, 180, 191; 455/600, 601, 7, 604, 11, 13, 14, 16; 179/99 R

[56] References Cited

U.S. PATENT DOCUMENTS 3,302,113 1/1967 Clay ..... 455/7
4,041,470 8/1977 Slane et al. ..... 340/52 R

FOREIGN PATENT DOCUMENTS 31632 2/1983 Japan .

*Primary Examiner*—Donnie L. Crosland
*Attorney, Agent, or Firm*—Wenderoth, Lind & Ponack

[57] ABSTRACT

A light transmission system for a train which includes sub-train compositions. Ths subtrain compositions each have end vehicles, one of which forms a head and the other of which forms a tail with respect to the moving direction of the train. The end vehicles each include a central station responsive to a first command signal from the front platform of the train to perform a central function for producing a second command signal and responsive to the second command signal to perform a terminal function which passes therethrough any input signal when an adjacent central station is found to be connected thereto and which returns any input signal when no adjacent central station is found to be connected thereto, thereby forming a complete signal transmission path in the train.

5 Claims, 19 Drawing Figures

COMMAND DEV.
CENTRAL STA.
CENTRAL STAS.
FIBER CABLES
CD
CS
C S
26
24
24a
32
34
E
F
G (LOOP-BACK MODE)

(LOOP-BACK MODE)

(BYPASS MODE)

(BYPASS MODE)

LIGHT TRANSMISSION SYSTEM FOR TRAINS

CROSS REFERENCE TO RELATED APPLICATIONS

This patent application is a continuation-in-part of now abandoned U.S. patent application Ser. No. 598,451 filed Apr. 9, 1984 now abandoned.

BACKGROUND OF THE INVENTION

This invention relates to a light transmission system for a train including a plurality of vehicles which is divided into one or more vehicle groups or compositions.

In the past, signal transmission in a transmission system between the vehicles of a railway train has been made by means of one electric wire per signal in almost all cases. Therefore, the number of wires required for the transmission system of the whole train usually amounts to 100–200 wires, resulting in reduced flexibility, reliability, manageability, and noise-resistance of the system.

Additionally, while the quantity of information as well as the transmission rate of signals transmitted between the vehicles tend to increase with the improvements in recent train control systems for the convenience of passengers, it is gradually getting more difficult to further reduce the above defects to perform signal transmission in a conventional system in which using one transmission path per transmission signal is provided between the vehicles.

For the solution of this problem, there has been proposed a system which multiplexes the signals from respective control apparatuses provided in the vehicles and causes the transmission thereof while largely reducing the number of signal wires passing through the vehicles; more particularly, a light transmission system has been introduced which utilizes an optical fiber cable which is excellent in flexibility and is capable of high speed transmission over a wide band as a signal transmission medium.

Such a conventional light transmission system for a train is illustrated in FIG. 1. The train is formed of end vehicles 10 and 10*a*, and middle vehicles 12*a*–12*c*. One of the end vehicles can be considered as a head vehicle and the other as a tail vehicle according to the moving direction of the train. The end vehicle 10 includes a central station 14 of the light transmission system while the end vehicle 10*a* includes another central station 16. The middle vehicles 12*a*–12*c* each include a respective terminal station 18 of the light transmission system. The central stations 14 and 16 are respectively connected to separate control apparatuses 20 while the terminal stations 18 are respectively connected to separate control apparatuses 22. The central stations are connected to the terminal stations through optical fiber cables 24 and 24*a* forming a signal transmission path. The terminal stations 18 are disposed in every other vehicle from each end vehicle for the respective transmission paths 24 and 24*a* for going and returning so that the number of the connection points between the stations does not exceed four in order to suppress the upper attenuation limit at the connections, as disclosed in Japanese Laid-open Patent Application No. 58-31632, published on Feb. 24, 1983.

The end vehicles 10 and 10*a* respectively include commanding devices 26 and 28 such as a master control or a brake valve which are respectively connected to the central stations 14 and 16.

In FIG. 1, when the train moves in the direction shown by arrow A, the central station 14 of the head vehicle 10 receives from the commanding device 26 a command signal which in turn is transmitted through the terminal stations 18 to the central station 16 of the tail vehicle 10*a*. The terminal stations 18 and the central station 16 respectively provide the corresponding command signals for the control apparatuses 22 and 20 which provide information of their status to the central station 14 which in turn provides status information as its output to a display portion (not shown) in the front platform of the head vehicle 10. It is to be noted that the central stations 14 and 16 are mutually exchanged in function when the moving direction of the train is opposite to the arrow A in FIG. 1.

Since the central stations 14 and 16 of the light transmission system change their functions in accordance with the moving direction of the train as set forth above, it can be said that one of the central stations in the head vehicle of the train which transmits a driving command signal has a central function while the other of the central stations in the tail vehicle of the train which receives the driving command signal and then provides a corresponding command signal for the control apparatuses has a terminal function. It is to be noted that all the terminal stations only have a terminal function of passing any input signal without any processing thereof.

Next, in the case as shown in FIG. 2, where a system comprising sub-train compositions B and C of five vehicles each as one unit, respectively, combined to form a complete composition D of ten vehicles is introduced, the central station 14 in the head vehicle 10 in the composition B with respect to the moving direction shown by arrow A in FIG. 2 performs the central function while the central station 16 of the tail vehicle 10*a* of the composition B and the central stations 14 and 16 in the composition C perform the terminal function, respectively.

Therefore, the above described system is disadvantageous in that all of the central stations, except for the head vehicle 10 in the composition B, have to be switched over to the terminal function and also a new transmission path interconnecting the compositions B and C must be provided to drive the train composition D as a unit.

SUMMARY OF THE INVENTION

It is accordingly an object of the present invention to provide a light transmission system for a train including sub-train compositions composed of a plurality of interconnected vehicles in which the head vehicle with respect to the moving direction of a train originally provides a command signal which results in the formation of a complete transmission path throughout all of the vehicles of a train.

In order to accomplish the above object, the light transmission system for a train including at least two subtrain compositions each composed of a plurality of interconnected vehicles including end vehicles according to the present invention broadly comprises command signal generating means disposed in each of the end vehicles of the train. This means in a selected one of the end vehicles as a head vehicle generates a first command signal. The system also comprises central stations respectively disposed in each of the end vehicles. Each of the central stations is responsive to the first command signal to perform a central function for generating a second command signal and responsive to a received second command signal to perform a terminal function, which passes therethrough any signals input thereto when the central station is not a designated last central station and which returns any input signal when the central station is the designated last central station.

BRIEF DESCRIPTION OF THE DRAWINGS

Throughout the figures, the same reference numerals indicate the identical or corresponding portions.

DETAILED DESCRIPTION OF THE PREFERRED EMBODIMENT

Figure 3:
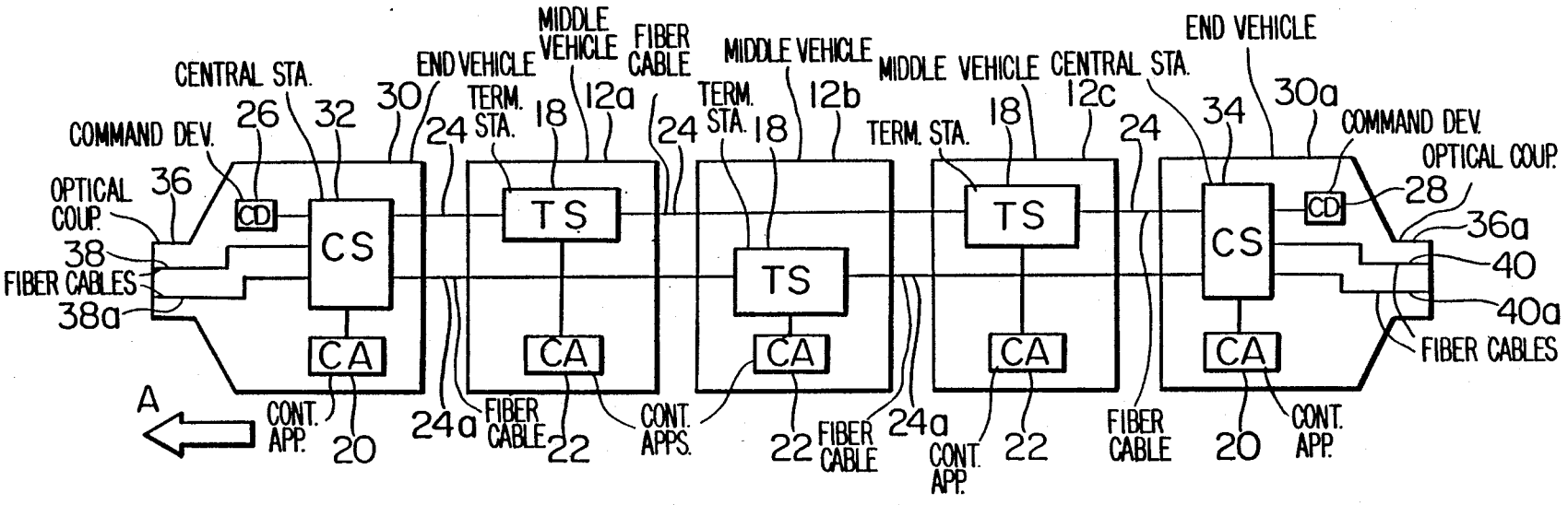
FIG. 3 shows a block diagram of one preferred embodiment of the light transmission system for a train according to the present invention.

Referring now to FIG. 3, there is shown a light transmission system for a train which comprises end vehicles 30 and **30*a* as well as middle vehicles 12*a*–12*c*, according to the present invention. The end vehicle 30 includes a central station 32 connected to the commanding device 26 and the control apparatus 20 while the end vehicle 30*a* includes a central station 34 which is the same in function as the central station 32 and which is connected to the commanding device 28 and the control apparatus 20 which are also included in the end vehicle 30*a*. Generally, the central stations 32 and 34 are formed such that in the absence of a command signal from the commanding device 26 or 28 in the head vehicle as defined by the direction of travel of the train, such as in a state immediately after the train is energized, the respective central station 32 or 34 performs a terminal function of passing therethrough any input signals as a bypass mode, and after one of the respective central stations 32 and 34** has received a first command signal from the respective commanding device in the head vehicle, it performs a central function, the central station receiving the first command signal instructing the other central stations via a second command signal to perform in a terminal function mode of operation of passing any input signal as a bypass mode when an adjacent central station is found to be connected, and of returning any input signal when an adjacent central station is found to be connected in a loop-back mode.

The end vehicles 30 and **30*a* are provided with optical couplers 36 and 36*a*, respectively, and with optical fiber cables 38, 38*a* and 40, 40*a* which are connected to the central stations 32 and 34**, respectively, to interconnect adjacent central stations as respective signal transmission paths.

Figure 1:
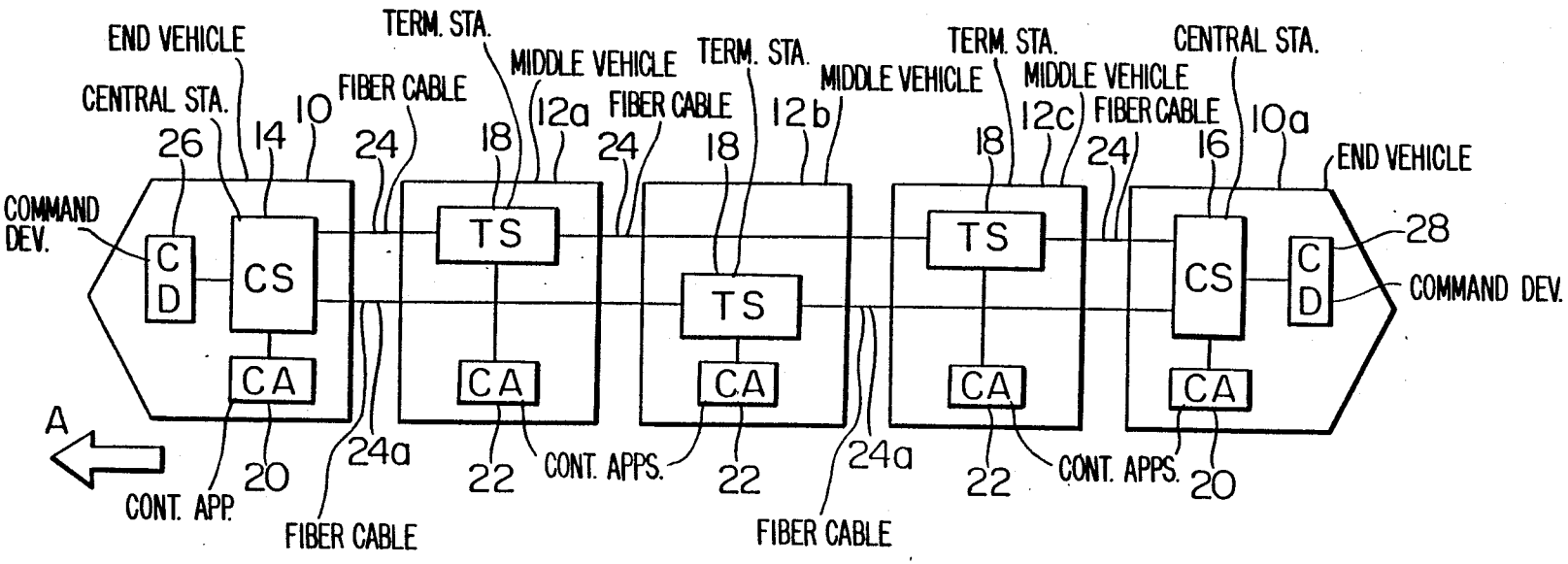
FIG. 1 PRIOR ART
FIG. 1 shows a block diagram of a prior art light transmission system for a train.
Figure 2:
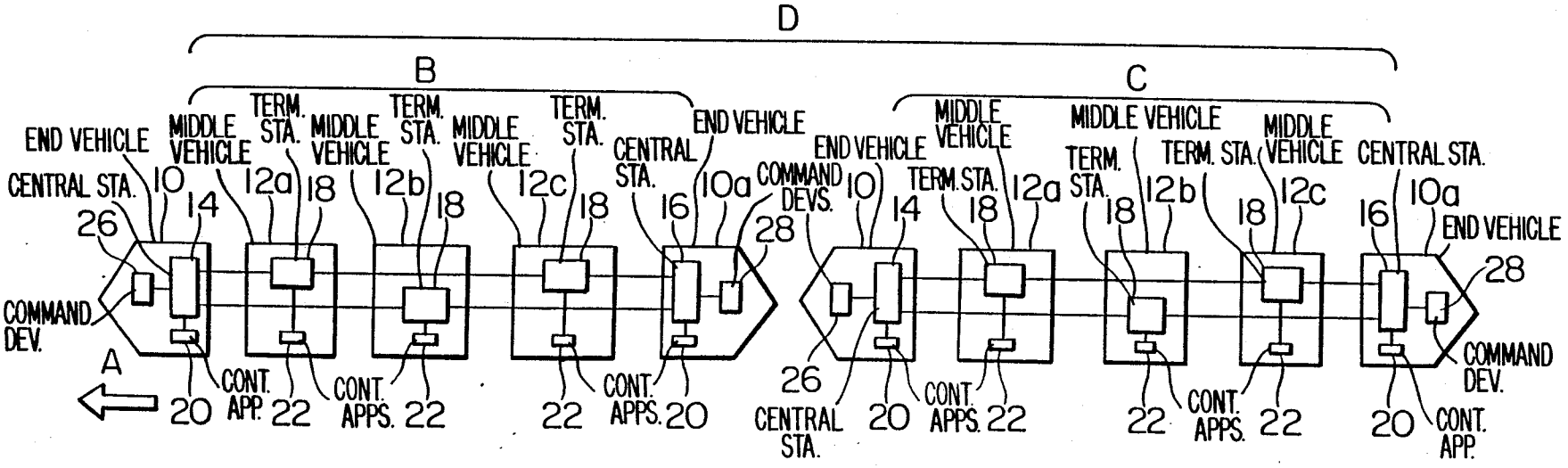
FIG. 2 PRIOR ART
FIG. 2 shows a block diagram of a prior art light transmission system for a train combining two similar train compositions of FIG. 1.
Figure 4:
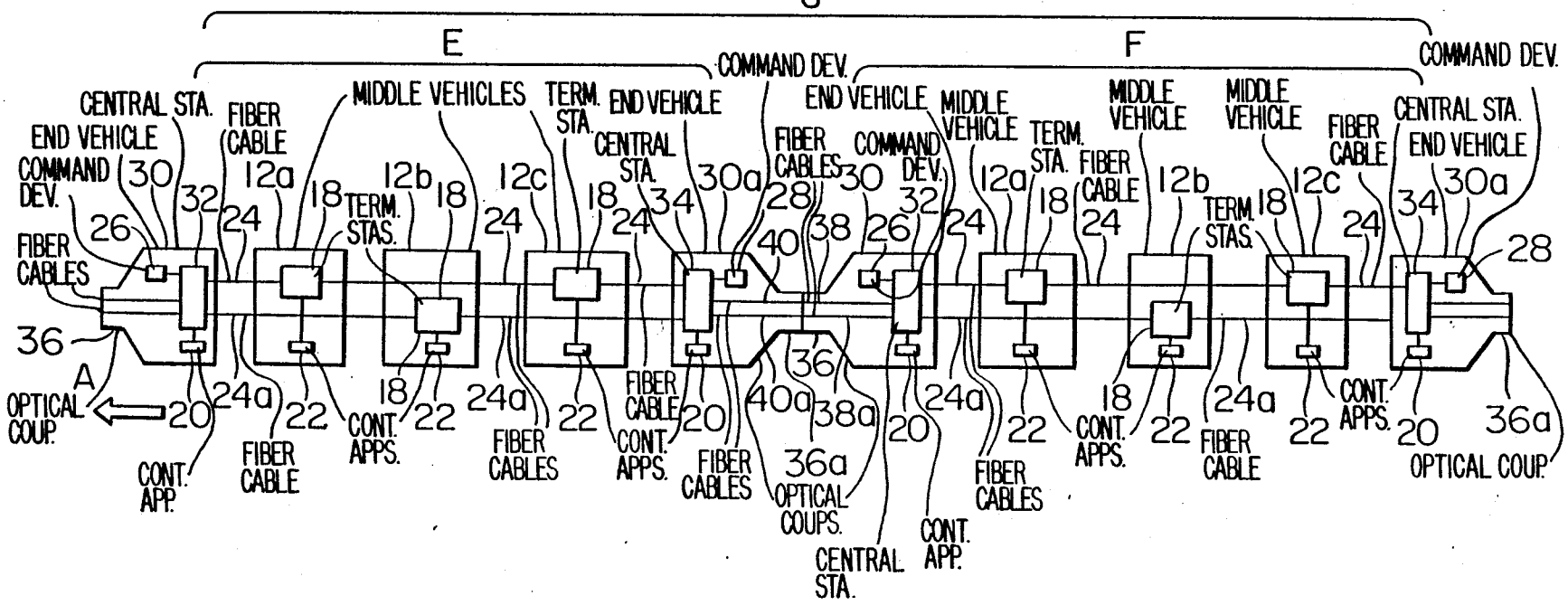
FIG. 4 shows a block diagram of the light transmission system for a train, according to the present invention, combining two similar train compositions of FIG. 3.

The operation of the light transmission system for a train in FIG. 3 according to the present invention will now be described with reference to FIG. 4 which shows a train composition G of ten vehicles comprised of sub-train compositions E and F each having five vehicles, similar to FIG. 2 and with reference to FIGS. 5A–5E which show a schematic diagrams of FIG. 4.

The sub-train compositions E and F of the five vehicles are mutually connected through the optical couplers 36 and **36*a* respectively provided for the end vehicles 30 and 30*a*, so that the central stations 34 and 32 are mutually connected through the optical fiber cables 38, 38*a* and 40, 40*a***.

Figures 5A, 5B, 5C, 5D, 5E:
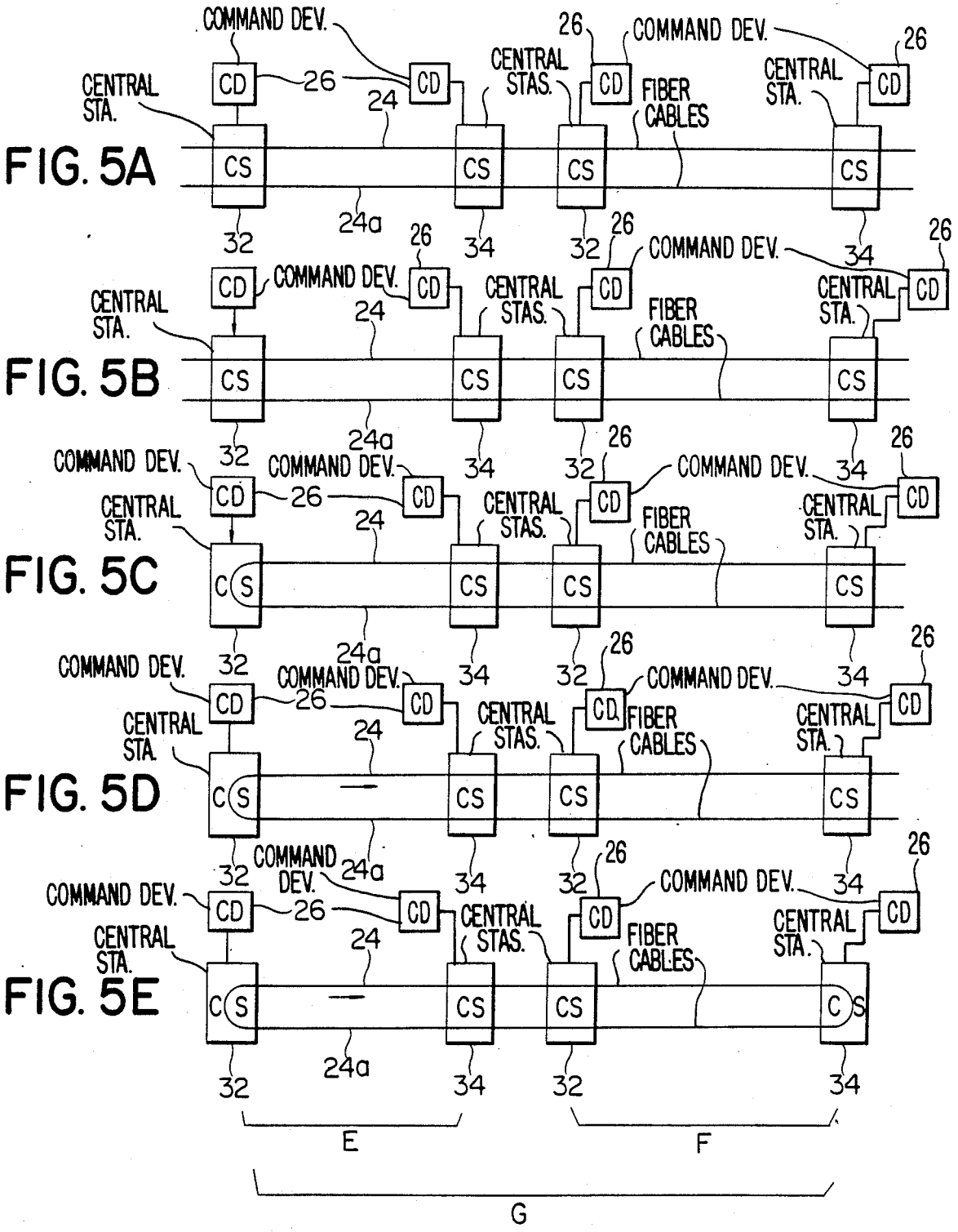
FIGS. 5A–5E show schematic diagrams of the arrangement of FIG. 4 in order to illustrate how a complete signal transmission path for a train is made according to the invention.

At the first stage when the train of the composition G is wholly energized with electric power, all of the central stations 32 and 34 are initially set in a bypass mode which passes any input signal therethrough, thereby standing by for a command signal, as shown in FIG. 5A.

In this state, when the train of the composition G is decided to be driven in the direction shown by the arrow A, the commanding device 26 of the head vehicle 30 of the sub-train composition E is energized by an operator or a conductor to send a first command signal to the associated central station 32 of the end vehicle 30 as shown in FIG. 5B.

The first command signal activates the central station 32 so that it operates in a central function by which central station 32 provides as an output a second command signal responsive to the first command signal from the commanding device 26, and operates in a loop-back mode which returns any input signal, as shown in FIG. 5C. It is to be noted that in this case the leftmost central station 32 may not necessarily form in the loop-back mode.

The second command signal provided by the central station 32 of the sub-train composition E is forwarded to the adjacent central station 34 of the tail vehicle **30*a* of the sub-train composition E through the terminal stations 18 as shown in FIG. 5D**. In this case, the second command signal comprises two types of command signals one of which has a predetermined fixed address signal for addressing a possible maximum number of central stations and the other of which has a variable address signal starting from a predetermined initial address.

The central station 34 in the bypass mode then sends the second command signal to the next central station 32 also in the bypass mode, of the head vehicle 30 of the sub-train composition F. The central station 32 of the composition F then sends the second command signal to the central station 34, of the tail vehicle **30*a* of the sub-train composition F, which now performs the loop-back function because the central station 34 of the composition F has now been addressed since no further central station is connected thereto. Therefore, command signal transmission paths 24 and 24*a* are completed between the central stations 32 of the composition E which performs the central function and the other central stations in the train composition G which perform the terminal function, as shown in FIG. 5E**.

The operation of completing the command signal transmission paths of 24 and 24*a* as shown in FIGS. 5D and 5E will now be described in more detail with further reference to FIGS. 6A–6C.

Figure 6A:
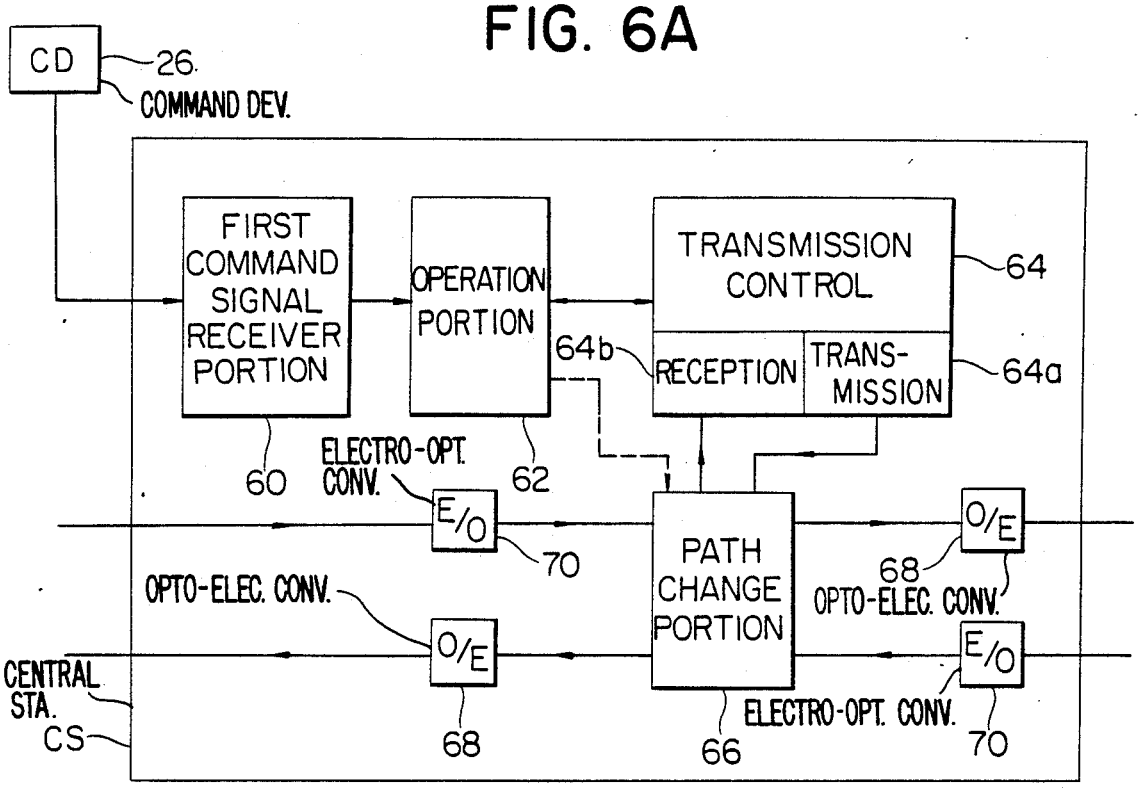
FIGS. 6A–6C show the arrangement of the hard ware of a central station as well as the function thereof.
Figure 6B:
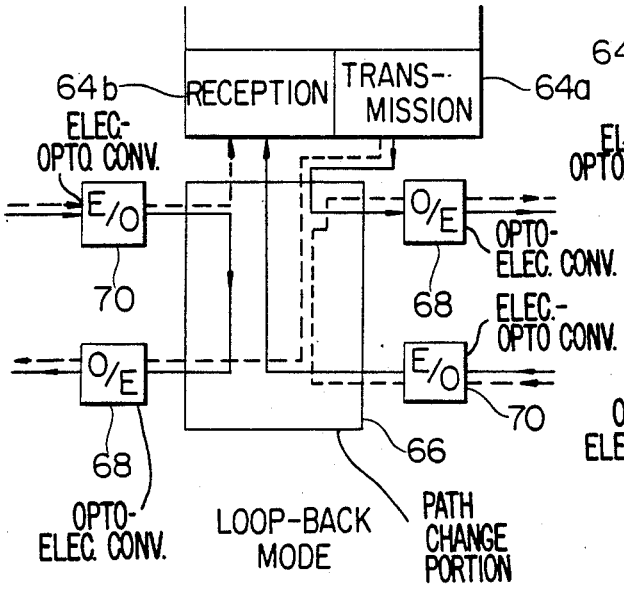
Figure 6C:
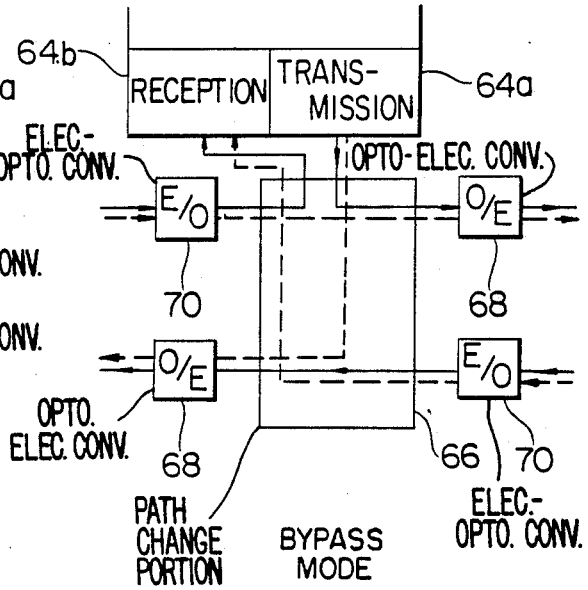

When a central station such as 32 of the end vehicle 30 of the sub-train composition E in the above example receives the first command signal from the associated commanding device such as 26, the central station performs in the loop-back mode as shown in FIG. 6B through a first command signal receiving portion 60, operation portion 62, transmission control 64 which includes a transmitter portion 64*a* and a receiver portion 64*b*, and a path change portion 66 in FIG. 6A. The central station then provides as an output the second command signal from the operation portion 62 through the transmission control 64, the path change portion 66, and the opto-electrical converter 68 toward the adjacent central station 34 of the sub-train composition E. As set forth previously, since the second command signal comprises two types of address signals, the adjacent central station 34, which remains in the bypass mode at the initial stage as shown in FIG. 6C, of the sub-train composition E receives both address signals at the operation portion 62 through the opto-electrical converter 68 and the reception portion 64*b* of the transmission control 64. The operation portion 62 then adds "one" to the variable address signal which has already been assigned to a predetermined initial address, for example "1". Therefore, a new address signal of address "2" is generated and compared with the fixed maximum address, for example "6", at the operation portion 62. In this case, the new address "2" is not equal to the fixed maximum address "6" so that the operation portion 62 instructs the path change portion 66 to remain in the bypass mode as shown in FIG. 6C. The next central station 32 of the end vehicle 30 of the sub-train composition F is operated similarly and operates in the bypass mode since the address comparison is found to be different. This also applies to the final central station 34 of the sub-train composition F because the calculated address number "4" of this central station is different from the fixed maximum address "6".

Therefore, the central station 32 of the sub-train composition E receives no response signal from the following central stations and so its operation portion 62 subtracts "one" from the fixed maximum address "6" thereby transmitting the second command signal with a fixed maximum address "5". Also in this address "5", the central station 32 of the sub-train composition E receives no response signal from the following central stations. By the repetition of this operation, the second command signal with a fixed maximum address "4" is to be found identical with an address signal "4" produced at the operation portion 62 of the central station 34 of the sub-train composition F. Then, the last central station 34 of the sub-train composition F changes over to the loop-back mode as shown in FIG. 6B, resulting in a completed loop as shown in FIG. 5E. It is to be noted that if a train has fixed sub-train compositions, the operation portion 62 of each of the central stations may have a predetermined own address in itself without any calculation of address addition in the above in order to directly compare with the fixed maximum address.

Figure 7:
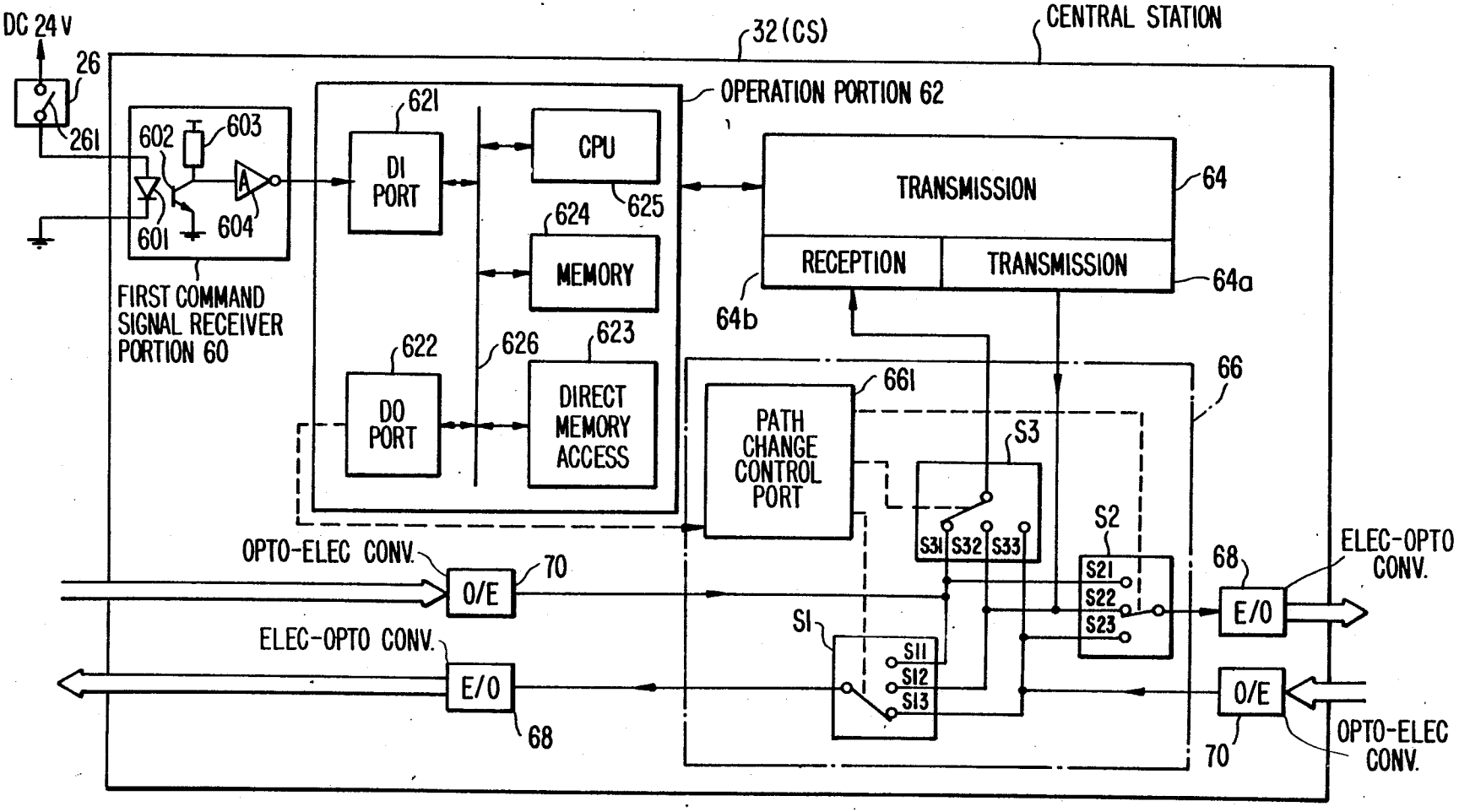
FIG. 7 shows a schematic block diagram of the central station which shows in greater detail the construction thereof according to the present invention.

FIG. 7 shows a schematic block diagram of the central station 32 or 34 which shows in greater detail the construction thereof according to the present invention. The same reference numerals are utilized to indicate the same portions shown in FIGS. 1–6. Referring to FIG. 7, the signal receiver portion 60 comprises a light emitting diode 601 a photo-transistor 602, a resistor 603 and an amplifier 604. The commanding device 26 comprises a switch 261 one terminal of which is connected to a 24V D-C power source and the other terminal or which is connected through the light emitting diode 601 of the signal receiver portion 60 to ground. Accordingly, when the switch 261 is closed by an operator who is positioned at the head vehicle of the train, the light emitting diode 601 activates the transistor 602 causing the voltage at the collector thereof to drop which causes the output of the amplifier 604 to go high, i.e. the command signal receiver portion 60 provides as an output therefrom a first command signal.

The operation portion 62 comprises a DI port 621, a DO port 622, a direct memory access 623, a memory 624 and a CPU 625 interconnected by a bus 626. The path change portion 66 comprises selector switches S1–S3 and a path change control port 661 which in response to a change-over instruction signal from the DO port 622, controls the positions to which the selector switches S1–S3 are switched, namely, whether the switches S1–S3 are in the loop-back mode or the bypass mode of operation. Specifically, the switches Sl, S2 and S3 being in respective positions Sll, S22 and S33 represents the loop-back mode (as shown by solid lines in FIG. 6B). Further, the switches Sl, S2 and S3 being in respective positions S13, S22 and S31 represents the bypass mode (as shown by solid lines in FIG. 6C). The above switch positions describe the loop-back mode and bypass mode for the case where the train is travelling in the direction A shown in FIGS. 1 and 2. However, in the case where the train is travelling in the other direction, the switches Sl, S2 and S3 are switched to positions S12, S23 and S31, respectively, for the loop-back mode and to positions S12, S21 and S33, respectively, for the bypass mode of operation (as shown by dotted lines in FIGS. 6B and 6C). The remaining portions are the same as described with respect to FIGS. 1–6.

Figure 8A:
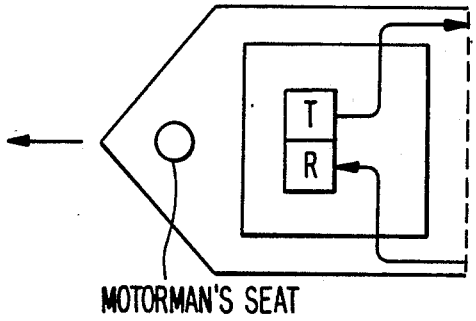
FIGS. 8A–8D generally show connection modes for the loop-back mode and bypass mode in the central stations.
Figure 8C:
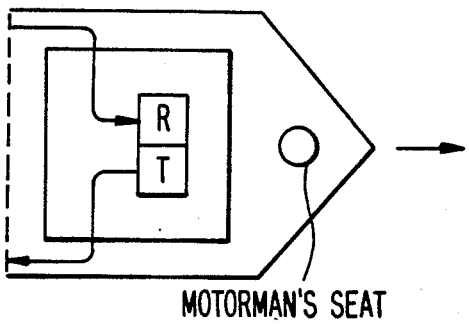
Figure 8B:
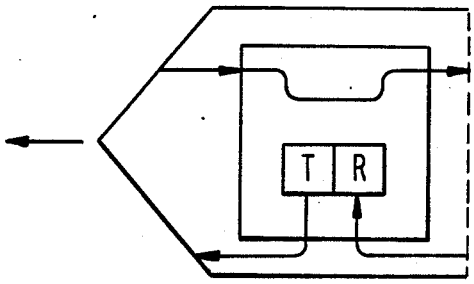
Figure 8D:
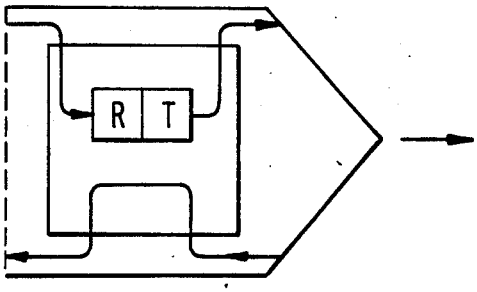

FIG. 8 generally shows the loop-back mode and bypass mode of operation as a function of the central station's position i.e., whether it is an end central station or a middle central station, and as a function of the train's direction of travel (as indicated by which end of the train a first command signal was detected), wherein FIGS. 8A and 8B (8C and 8D) show an end central station and a middle central station in a loop-back mode and a bypass mode, respectively, for the case where the train is travelling in a direction towards the left side of the page and FIGS. 8C and 8D show an end central station and a middle central station in a loop-back mode and a bypass mode, respectively, for the case where the train is travelling in a direction towards the right side of the page. The symbols R and T are representative of the reception devices 64*b* and transmission devices 64*a* in the respective transmission controls 64.

FIG. 9 shows a flow chart of a program stored in each memory unit 624 of the operation portions 62 of the central stations 32 and 34 which is utilized for determining whether;

1. the respective central stations are to be controlled in the central function or the terminal function mode of operation as a function of the detection of a first control signal;

2. the respective path change portions 66 are to be controlled in a loop-back or a bypass mode of operation; and 3. the respective information to be transmitted by the second control signal.

Figure 9A:
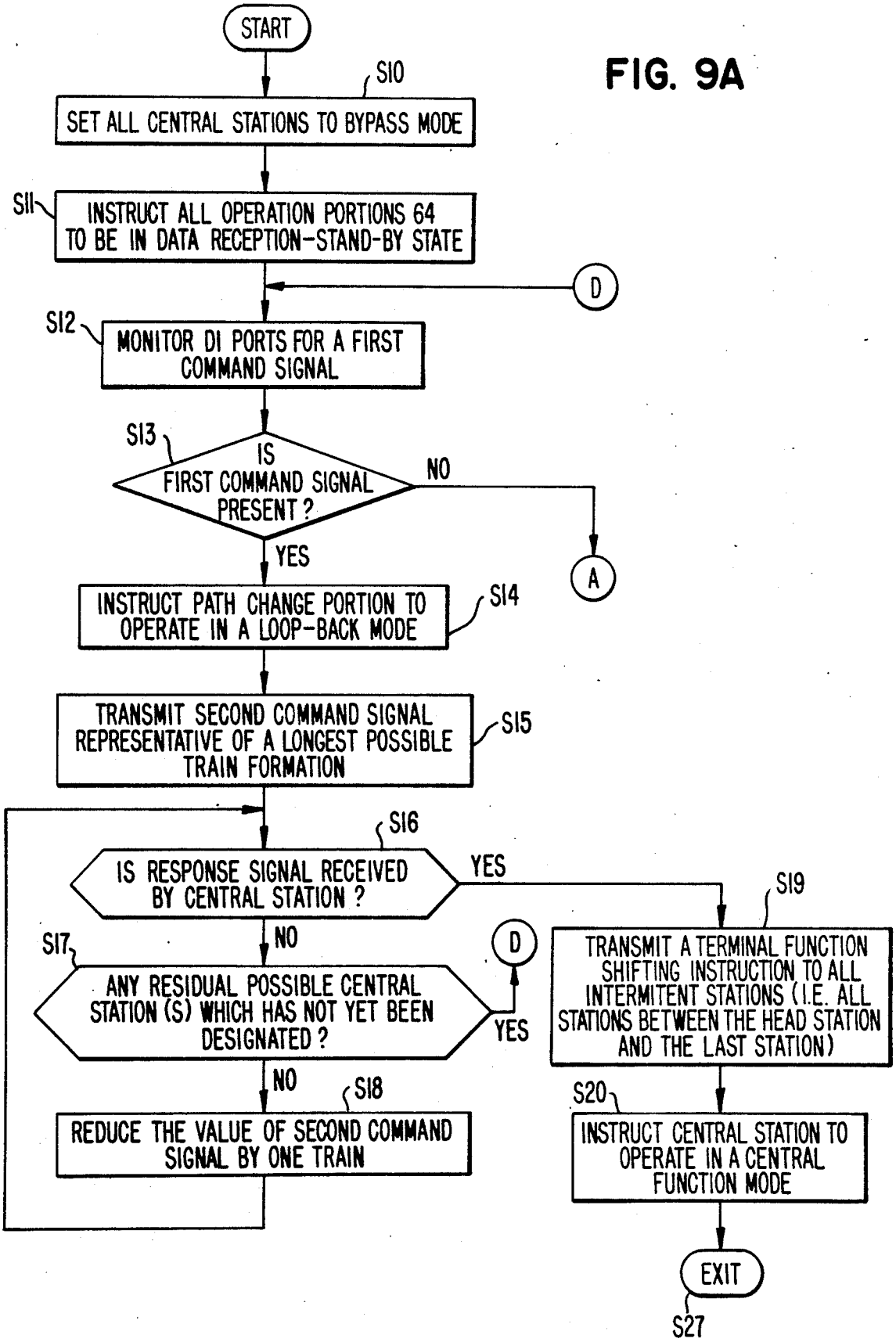
FIGS. 9A and 9B show a flow chart of a program stored in each memory unit of the operation portions of the central stations according to the present invention.
Figure 9B:
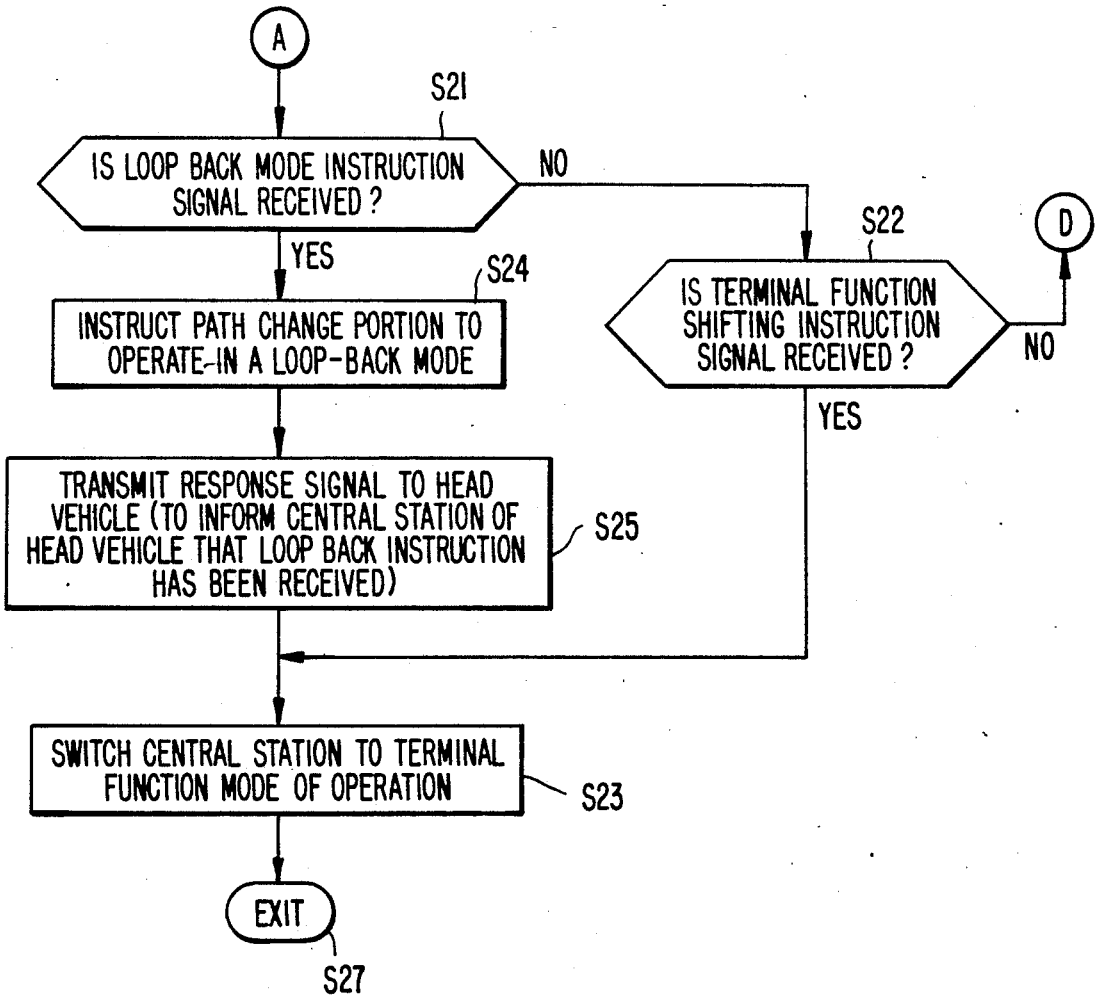

Referring to FIGS. 9A and 9B, after the program is started i.e. when the train is electrically energized, at step S10, each operation portion 62 issues a change-over instruction signal (i.e. via the dotted line from the DO port 622) to the respective path change control port 661, which, in turn, controls all the selector switches to be in the bypass mode of operation (i.e. Sl=S13; S2=S22; and S3=S31 as shown in FIG. 5A). Next, at step Sll, each operation portions 62 outputs an instruction signal to the respective transmission control units 64 to be in a data reception-stand-by state of operation. Next, a step S12, each CPU unit 625 checks for the above noted first command signal in the respective DI ports 621. In other words, when the CD switch 26 is closed by an operator, the first command signal is generated and received by the corresponding first command signal receiver portion 60 of the head vehicle of the train according to the travelling direction thereof as shown in FIG. 5B, which is subsequently sent to the respective DI port 621 of the head vehicle and, also at step S12, the output state of the respective DI port 621 is read by the CPU unit 625. Next, at step S13, each CPU unit 625 determines whether or not the first command signal is present in the respective DI ports 621.

First, the case where a first command signal is detected by a central station will be described.

If at step S13 the answer is YES, implying the one of the CPU units 625 has determined that the first command signal is present in the corresponding DI port 621, the program proceeds to step S14, where the central station (i.e. the station to which the first command signal is input) is switched over to the loop-back mode of operation as shown in FIG. 5C. Next, at step S15, the central station having received the first command signal outputs through the E/0 unit 68 thereof a second command signal representative of the largest train formation (i.e. a value which is representative of the furthest train which may be connected in a longest possible train formation) as shown in FIG. 5D, so that when the vehicle containing the central station defined by the information in said second command signal is connected in the train formation, that central station of that train when receiving that signal will be switched to the loop-back mode of operation (i.e., as will be mentioned at step S24). Next, at step S16 it is determined whether or not a response signal is present from the central station 34 in the presently considered last train (i.e. as transmitted at step S25). If at step S16 the answer is NO, implying that no such train is presently connected, the program proceeds to step S17 where it is determined whether or not there is any residual possible central station(s) which has not yet been designated, as set forth in the above with reference to FIGS. 5 and 6. If at step S17 the answer is YES, the program returns to step S12 whethere the same operation described above is repeated. If at step S17 the answer is NO, the program proceeds to step S18 where the value of the second command signal is reduced by one. In other words, the CPU in the central station which is operating in the central function mode of operation, after not receiving the response signal to the second command signal representative of the longest train combination possible, generates a second command signal representative of the central station in the next to the longest train formation, after which the program returns to step S16. Thus, the steps S16–S18 are repeated until the furthest vehicle of the train is found.

If at step S16 the answer is YES, implying that the response signal is received for the presently transmitted second command signal and, accordingly, that the number of vehicles presently interconnected is the same as the value defined by the presently transmitted second command signal, the program proceeds to step S19 where the central station acting in a central function mode of operation instructs all the central stations other than the last central station of the furthest vehicle to operate in the bypass mode of operation. Next, at step S20, the CPU 625 in the central station 32 instructs itself to switch over to the central function mode of operation, after which the program is exited at step S27.

Next, the case where a first command signal is not detected by a central station will be described.

If at step S13 the answer is NO, the program proceeds to step S21 where it is determined whether or not a loop-back instruction signal is present in the respective transmission control unit 64. More specifically, each CPU 625, after having determined at step S13 that no first command signal was supplied to the central station it is in, at step S21 whether or not the loop-back instruction signal has been received in the respective transmission control unit 54 through the reception unit 64*b* from the central station of the head vehicle via the optical fibre cable 38 is determined. If at step S21 the answer is NO, the program proceeds to step S22 where it is determined whether or not a terminal function-instruction signal is present in the respective transmission control unit 64. If at step S22 the answer is NO, the program returns to step S12. If at step S22 the answer is YES, the program proceeds to step S23, where the respective central station is switched over to the terminal function mode of operation, after which the program is exited at step S27.

It should be noted that no extra step is necessary between steps S22 and S23 for instructing the intermittent central station(s) to operate in the bypass mode because this has already been done at step S10.

If at step S21 the answer is YES, implying that the CPU 625 determining this is in the last (furthest) central station, the program proceeds to step S24 where the path change portion 66 is switched to the loop-back mode of operation. Next, at step S25, the operation portion 62 of the last central station 32 outputs an insutruction to the corresponding transmission control 64 to transmit therefrom a response signal indicating that the loop-back instruction data has been received (i.e. indicating theat the last central station has been identified and switched to a loop-back mode of operation). Next, the program proceeds to step S23, where the last central station is switched over to the terminal function mode of operation, after which the program is excited at step S27.

Accordingly, steps S19–S25 are executed by the CPUs of all the central stations not receiving a first command signal, whereby, these stations are either controlled in a loop-back mode of operation (i.e. step S24) or a bypass mode of operation (i.e. step S23) as shown in FIG. 5E.

As in the above, the light transmission system for a train according to the present invention includes central stations which can change the predetermined mode of operations in response to the kind of command signal and therefore the central station in the front platform performs a central function and the remaining central stations perform a terminal function, as defined by the direction of the travel of the train, resulting in an easy coupling of sub-train compositions and disconnection thereof.

It will be appreciated by one of ordinary skills in the art that the present invention is not limited to the described embodiment but various modifications are possible without departing from the spirit of the invention.

What we claim is:

1. A light transmission system for a train including at least two sub-train compositions each composed of a plurality of interconnected vehicles including end vehicles comprising a command signal generating means disposed in each of said end vehicles, said means in a selected one of said end vehicles used as a head vehicle for generating a first command signal; and central stations including at least one last central station respectively disposed in each of said end vehicles, each of said central stations including means for receiving operating signals and being responsive to said first command signal for generating a second command signal and responsive to a received second command signal for passing therethrough any of said operating signals input thereto when said central station is a station other than said at least one last central station and for returning any of said operating signals input thereto when said central station is said at least one last central station.

2. A light transmission system for a train according to claim 1, wherein said first commmand signal is generated by a signal generating means when said command signal generating means is energized by an operator.

3. A light transmission system for a train according to claim 1, wherein said end vehicles respectively have an optical coupler for interconnecting adjacent end vehicles of different sub-train compositions through optical fiber cables which are connected to associated central stations.

4. A light transmission system for a train according to claim 1, wherein each of said central stations includes an operation portion for generating said second command signal in response to said first command signal, said second command signal comprising a predetermined fixed maximum address signal corresponding to a predetermined maximum allowed number of said central stations in the train and a variable address signal starting from an initial address, and for adding a predetermined value to said variable address signal to form a new address signal and for comparing said new address signal with said fixed maximum address signal and for enabling said central to operate in a bypass mode when said new address signal is not equal to said fixed maximum address signal so as to pass therethrough any of said operating signals input thereto or so as to operate in a loopback mode when said fixed maximum address and new address signals are equal so as to return as an output therefrom of said operating signals input thereto.

5. A light transmission system for a train according to claim 1, wherein each of said central stations includes an operation portion which generates said second command signal in response to said first command signal, said second command signal comprising a predetermined fixed maximum address signal corresponding to a predetermined maximum allowed number of said central stations in the train and an assigned address, and which compares said assigned address signal with said fixed maximum address signal and enables said central station to operate in a bypass mode so as to pass therethrough any of said operating signals input thereto when said assigned address and fixed maximum address signals are different or to operate in a loop-back mode so as to return as an output therefrom any of said operating signals input thereto when said assigned address and fixed maximum address signals are equal.

* * * * *